US006132166A

United States Patent [19]

Migliorini

[11] Patent Number: 6,132,166

[45] Date of Patent: Oct. 17, 2000

[54] APPARATUS AND METHOD FOR POSITIONING TEXTILE ARTICLES

[75] Inventor: Pier Lorenzo Migliorini, Terranuova Bracciolini, Italy

[73] Assignee: Matec S.p.A., Italy

[21] Appl. No.: 09/074,775

[22] Filed: May 8, 1998

[30] Foreign Application Priority Data

Jun. 23, 1997 [IT] Italy ..... FI97A0150

[51] Int. Cl.[7] ..... D05B 23/00

[52] U.S. Cl. ..... 414/784; 112/475.12; 223/77

[58] Field of Search ..... 414/784, 816; 112/475.12; 223/77

[56] References Cited

U.S. PATENT DOCUMENTS

| | | | |
|---|---|---|---|
| 4,020,775 | 5/1977 | King et al. | 112/121.15 |
| 4,303,026 | 12/1981 | Ueda | 112/121.15 |
| 4,444,140 | 4/1984 | Moyer | 112/262.2 |
| 5,014,634 | 5/1991 | Hodges et al. | 112/262.2 |
| 5,272,993 | 12/1993 | Gazzarrini | 112/121.15 |
| 5,316,436 | 5/1994 | Main et al. | 414/816 |
| 5,345,889 | 9/1994 | Gazzarrini et al. | 112/262.2 |
| 5,564,609 | 10/1996 | Tsuchiya et al. | 223/75 |

FOREIGN PATENT DOCUMENTS

| | | |
|---|---|---|
| 0 116 445 | 8/1984 | European Pat. Off. . |
| 0 887 453 A1 | 12/1998 | European Pat. Off. . |
| 42 22 667 | 9/1993 | Germany . |
| 8-252385 | 10/1996 | Japan . |
| 2 042 322 | 9/1980 | United Kingdom . |

*Primary Examiner*—Thomas P. Noland
*Attorney, Agent, or Firm*—McGlew and Tuttle, P.C.

[57] ABSTRACT

Apparatus for positioning textile tubular articles according to a predetermined reference, comprising a structure (1) with, for each article (5) to be formed, two pairs of cylindrical parallel and superimposed rollers (4) rotatable about respective longitudinal axes, and on which the article in the process of formation is able to be fitted: at least one of the pairs of rollers (4) being associated to one or more detectors (7) intended to detect a longitudinal reference of the article and to determine, upon detection, the temporary compression-operated adhesion of the corresponding fabric portion of the article to the surface of a fixed body (4) located between the vertically superimposed rollers (4) of each pair by means of corresponding buffer pistons (70) associated thereto.

6 Claims, 5 Drawing Sheets

APPARATUS AND METHOD FOR POSITIONING TEXTILE ARTICLES

FIELD OF THE INVENTION

The present invention refers to an apparatus and to a method for positioning textile tubular items for the manufacturing of pantyhose articles.

BACKGROUND OF THE INVENTION

Pantyhose articles are known to be manufactured by joining two stocking, the portion of each stocking being subjected to a longitudinal cut of predetermined length and the two stockings being sewn together afterwards in correspondence of the cut edges. To this purpose, the stockings are fitted onto corresponding flat paired supporting shapes which allows them to be moved between a plurality of distirct loading, positioning, cutting, sewing and unloading stations of a horizontal carrousel machine so-called pantyhose-seamer or liner-closer.

Machines for the formation of pantyhose articles are described, for example, in the U.S. Pat. Nos. 4,444,140, 5,345,889 and 4,303,026.

Also known is the fact that in order to form items such as pantyhose articles starting from stockings having toes already seamed, it is necessary to suitably positioning and orienting the articles on the respective supporting shapes, so that the seam line of the toe in correspondence of each stocking and the sewing line for joining the edges which is to form the bodice will be suitably oriented with respect to one another; failing this, the article would result of poor quality by having the toe improperly oriented with respect to the bodice.

The sewing of the stocking toe is carried out by so-called toe-closer machines such as those described in the U.S. Pat. Nos. 5,014,634, 5,272,993 and 4,020,775.

The U.S Pat. No. 5,564,609 describes an apparatus able to position articles such as stockings for pantyhose articles, comprising rollers acting from the outside on the articles in the process of formation to drive them into rotation about their respective longitudinal axes and thus orienting them according to a predetermined reference. A drawback arising from the use of this known positioning apparatus lies in the fact that the compression exerted by the rollers on the fabric of the article being positioned is cause for a considerable localized deformation of the fabric stitches, this drawback being more serious in case of light and delicate fabrics which do not consent the spontaneous elastic recovery of the deformation. Besides, the positioning of the article is only partially automatic since it is necessary to dispose the articles on the relevant support shapes in a precise initial arrangement.

SUMMARY AND OBJECTS OF THE INVENTION

The main object of the present invention is to provide an apparatus and a method allowing textile articles such as stockings for pantyhose articles to be oriented, particularly during the transfer thereof between stations or machines for the sewing of the toe and stations or machines for the formation of the pantyhose articles, in an automatic, fast and reliable way.

This result has been achieved, according to the invention, by providing an apparatus having the features of a pair of rollers rotatable about their respective longitudinal axis. These rollers are arranged substantially parallel and are spaced to fit inside the tubular textile article. A detector is associated with the pair of rollers and detects a longitudinal reference of the article on the pair of rollers. A fixed body is arranged between the rollers, and cooperates with a buffer piston to determine or establish compression-operated adhesion of the article to the fixed body upon detection of the longitudinal reference of the article. The rollers are rotated in order to rotate the tubular article around its own longitudinal axis until the longitudinal reference of the article is detected by the detector. Further characteristics are set forth in the dependent claims.

The advantages deriving from the present invention lie essentially in that it is possible to operate the above mentioned positioning in an automatic, reliable, rapid and accurate way so that the finished product will result always of the best quality; that an apparatus according to the invention is relatively simple to make and is able to be associated to means for the transfer of articles between a plurality of operating stations or machines of a plant wherein in each station or on each machine a corresponding operation is carried out.

These and other advantages and characteristics of the invention will be best understood by anyone skilled in the art from a reading of the following description in conjunction with the attached drawings given as a practical exemplification of the invention, but not to be considered in a limitative sense.

DESCRIPTION OF THE PREFERRED EMBODIMENT

Figure 2:
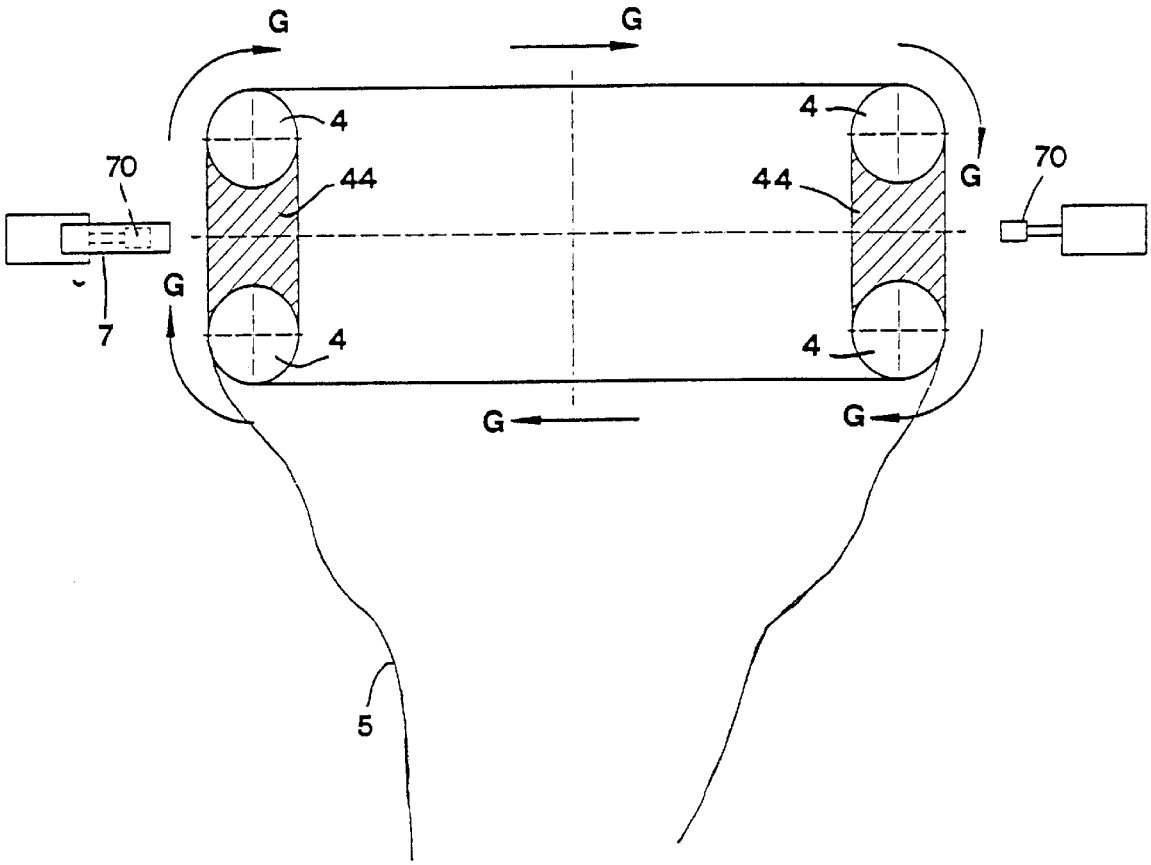
FIG. 2 shows a schematic diagram of the means of the apparatus shown in FIGS. 1A and 1B.

Reduced to its basic structure, and reference being made to the figures of the attached drawings, an apparatus according to the invention comprises a structure (1) positioned between two associated machines (2, 3) and with, for each article (5) to be formed, two pairs of cylindrical parallel and superimposed rollers (4) rotatable about respective longitudinal axes under control of respective motors (40), and on which rollers the article in the process of formation is able to be fitted by means of a carriage (6) with hooks (60) which provide for picking up the article from the first machine (3) in order to, fit it on the rollers (4): at least one of said pairs of rollers (4) being associated to one or more optoelectronic detectors (7) intended to detect a longitudinal reference of the article and to determine, upon said detection, the temporary compression-operated adhesion of the corresponding portion of article fabric to the surface of a fixed body (4) located between the vertically superimposed rollers (4) of each pair (see FIG. 2) by means of corresponding buffer pistons (70) associated thereto.

Figure 1A:
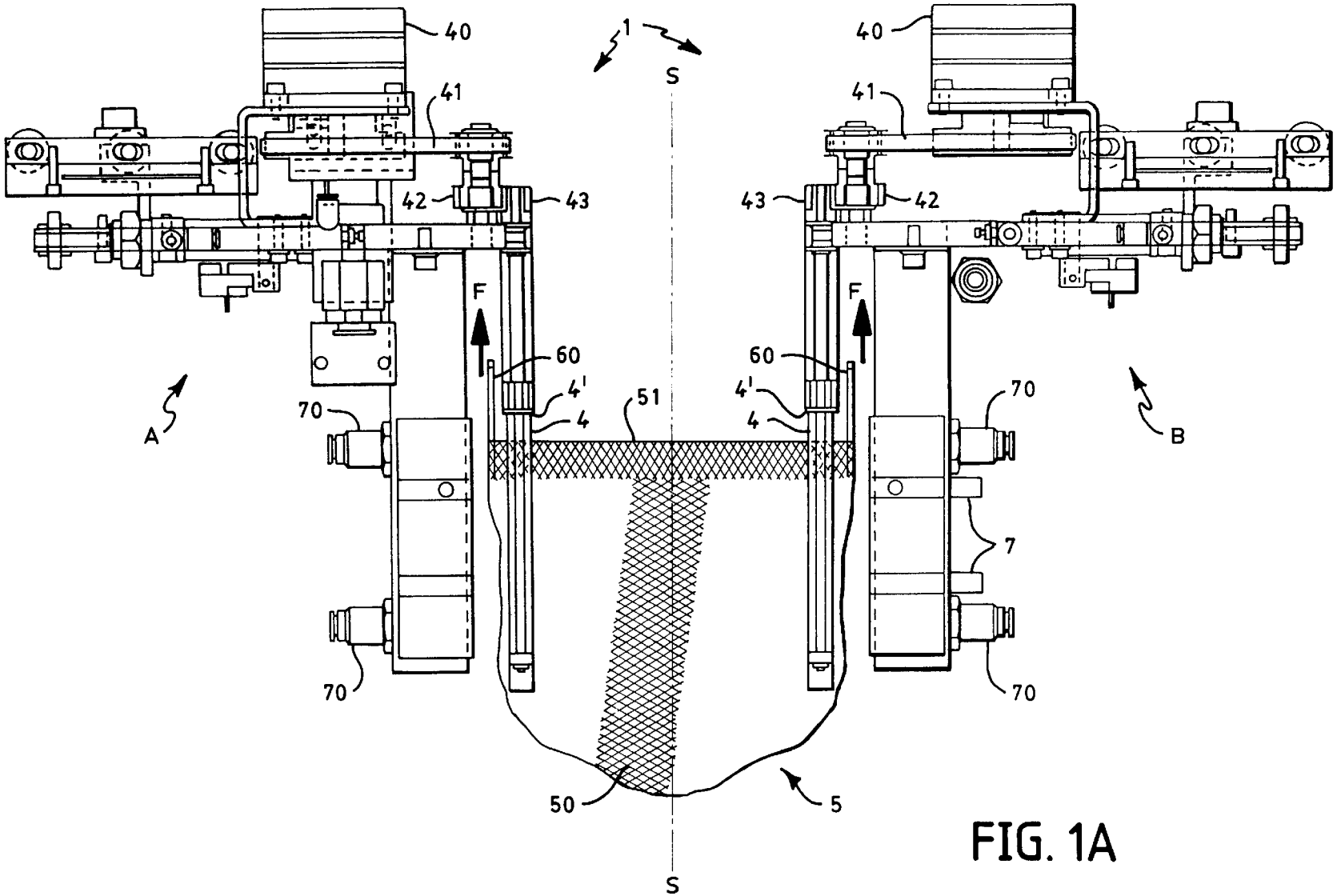
FIGS. 1A and 1B are plan views of an apparatus according to the invention, which show, respectively, the same apparatus at the beginning and at the end of the positioning.

The hooks (60) of the carriage (6) which takes the articles to the structure (1) are developed parallel to each other and to rollers (4) and spaced apart of such an extent as to be positioned outside the rollers (4) (as can be seen in FIG. 1A) in order to fit the respective articles (5) thereon, with the rollers resulting inside the article. The transfer of the articles (5) to the rollers (4) takes place through a translation of the carriage (60), as indicated by the arrows (F) in FIG. 1A, which causes the abutment and the stop of the front edge (51) of the articles (5) against the rear base (4') of the rollers (4) whose dimensions are suitably selected to provide such an effect. The further advancement of the carriage (6) in the direction indicated by arrows (f) of FIG. 1, which is followed by the lifting thereof after the stop abutment of the article (5), will cause the latter to be definitively take over by the rollers (4) of structure (1).

Figure 1B:
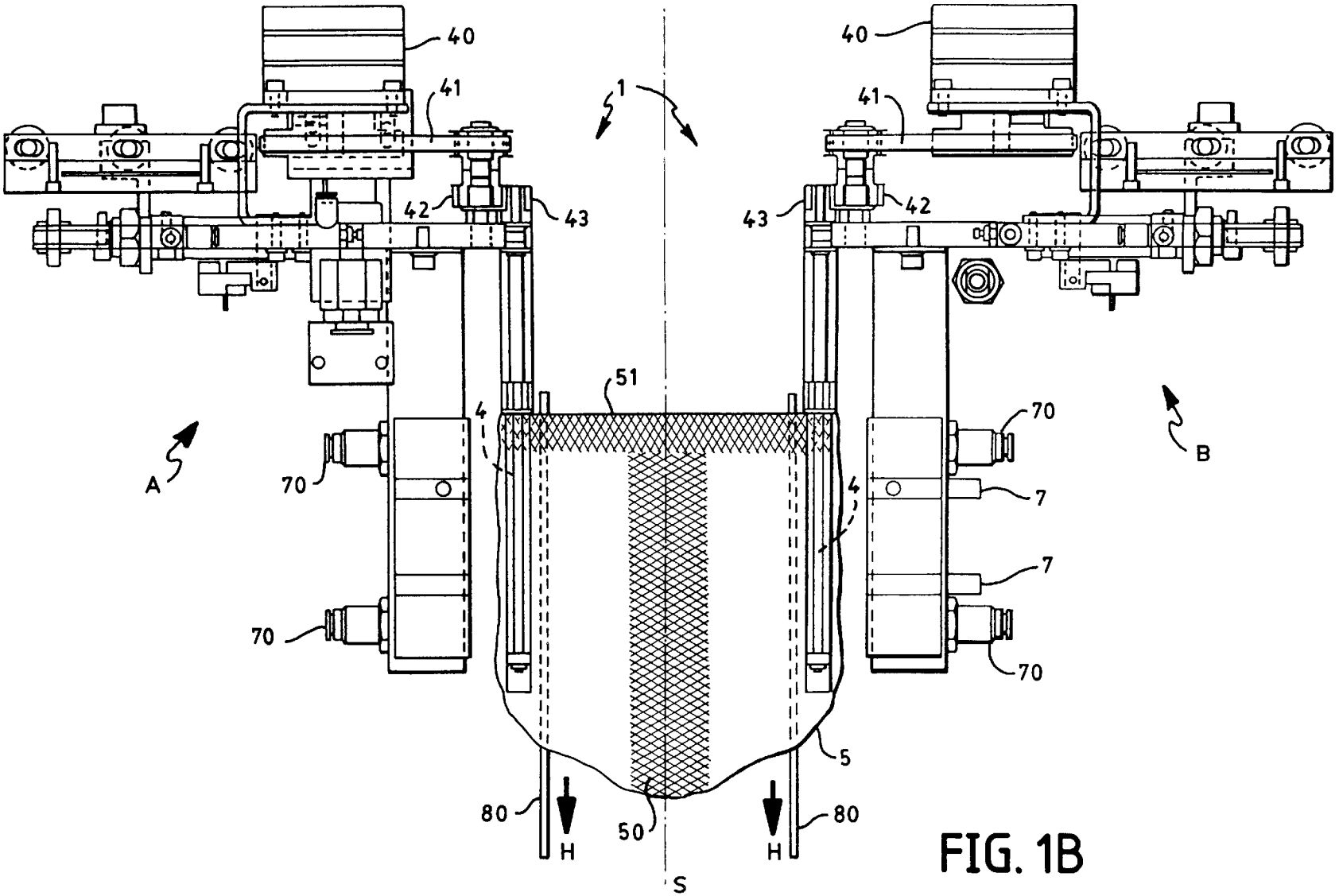

Once the article (5) has been removed from the machine (3) by the carriage (6)—the hooks (60) of the latter having their concavity facing the machine (3) which the articles to be treated (5) come from so as to have them taken over by an intermediate carriage (36) provided with hooks able to remove the elastic edge (51) of the articles from the support (30) of said machine (3) through a horizontal translation of predetermined length—the same carriage (6) taking the article (5) up to the structure (1) a) fit the elastic edge thereof onto the rollers (4) which result thus inside the article in the process of formation. Thereafter, the rollers (4) are driven into rotation so as to cause the article to rotate about its longitudinal axis, as indicated by the arrows (G) in the diagram of FIG. 2. As soon as one of the detectors (7) detects the reference (50) in the fabric of the article—the reference being, for example, a continuous or discontinuous longitudinal mark of a colour or thickness or material different from that of the fabric, or even a line or band of demarcation between two portions of the bodice having stitches of different thickness or structure (as indicated In FIGS. 1A and 1B)—the corresponding cylinders (70) are operated, either instantaneously or with a programmed constant delay, in order to compress the corresponding portion of the article fabric onto the surface of the body (44) and prevent the same article from rotating further on. When all the buffers of the cylinders (7) are caused to compress the fabric onto the surface of said body (44), the said reference results orthogonal to the read axes of detectors (7) and, therefore, the article results disposed on the tubes (4) at a known and predetermined spatial position which allows it to be removed, as described later on, and transferred to another machine (2) possibly after a further rotation of the same article about its longitudinal axis through an angle of predetermined extent.

Figure 3:
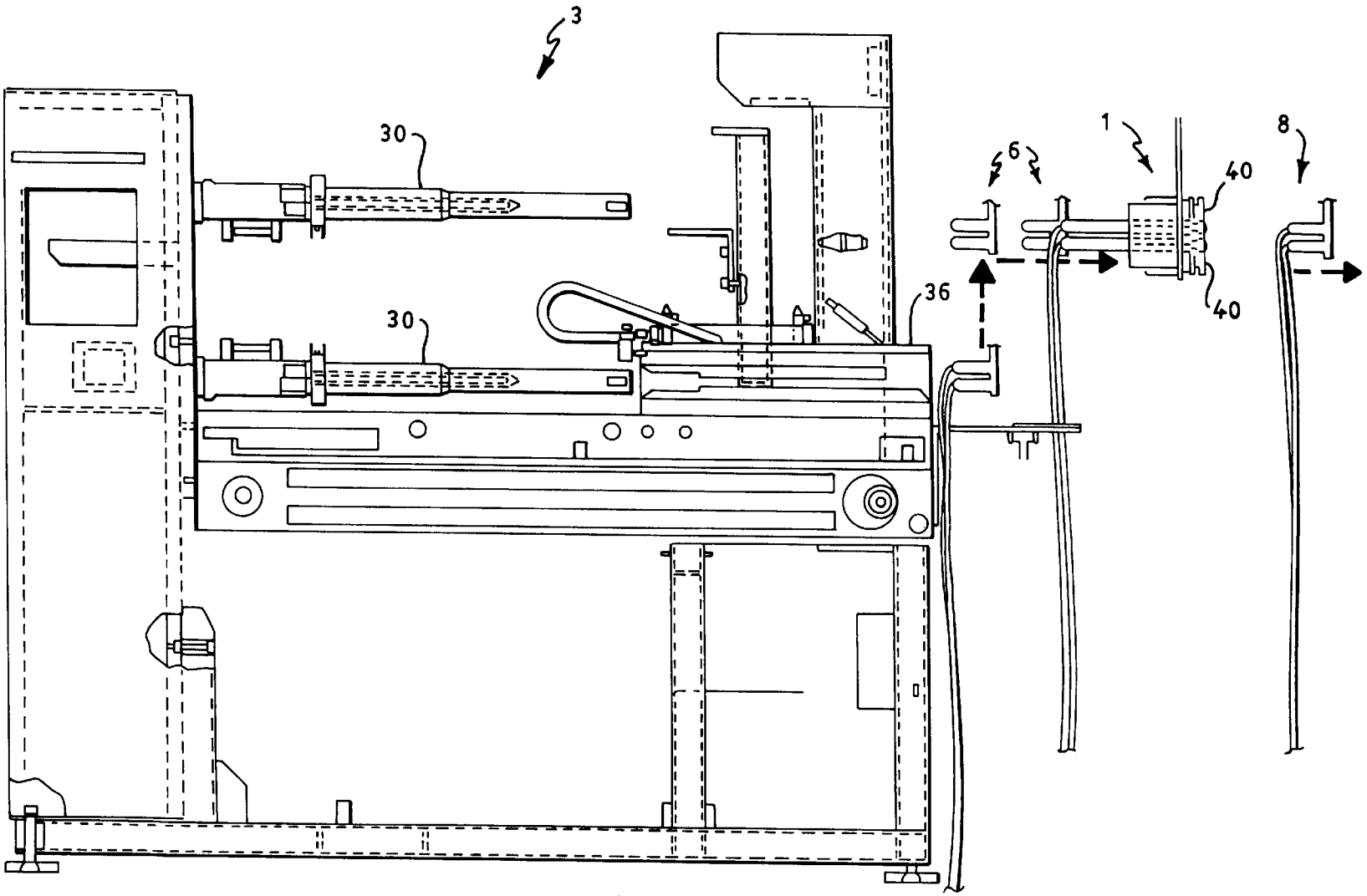
FIG. 3 shows schematically a side view of an apparatus, according to the invention, located downstream of a toe-closer and to which a carriage for feeding the articles to be positioned and a carriage for withdrawing the positioned articles are associated.
Figure 4:
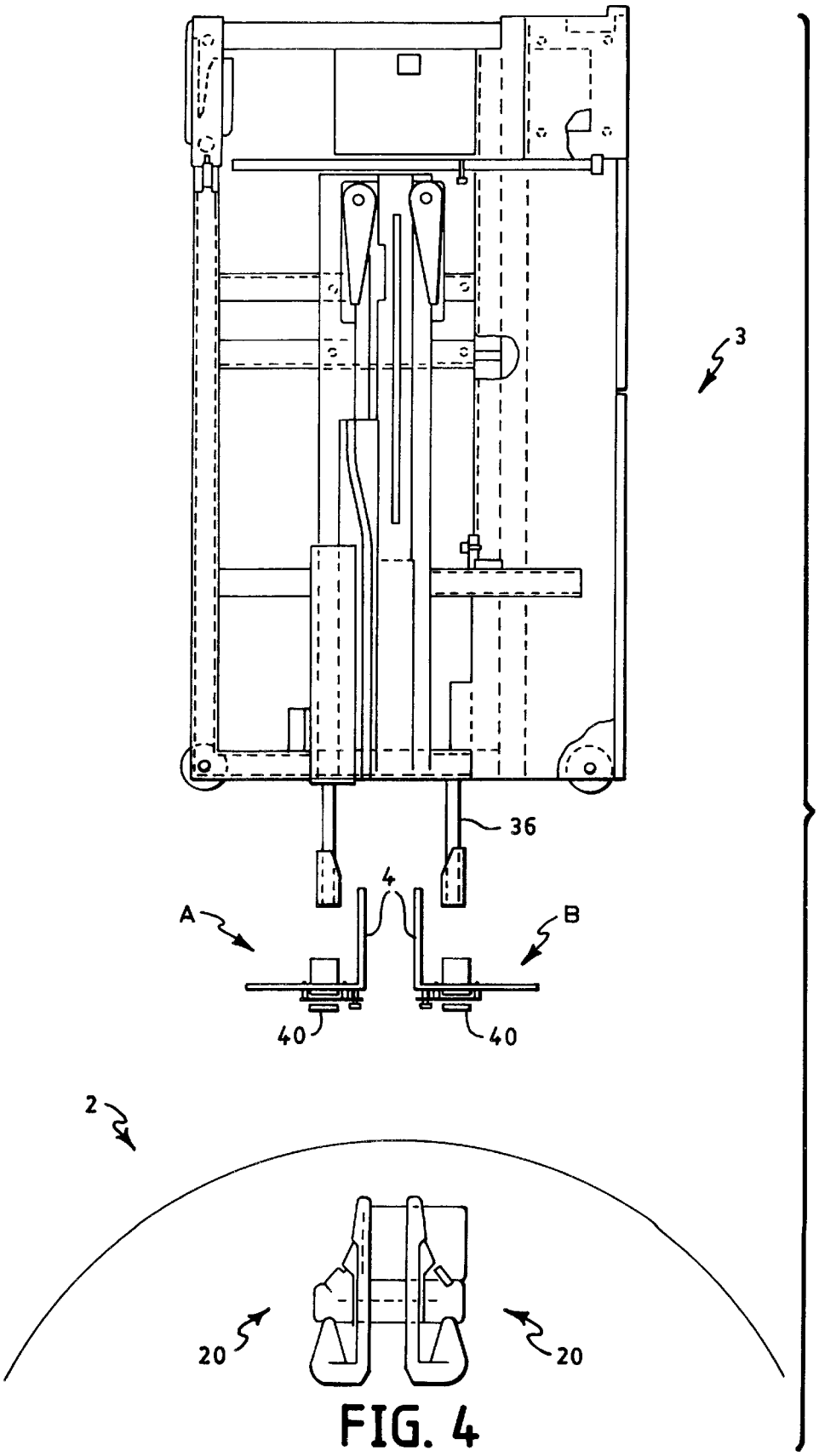
FIG. 4 shows schematically a plan view of an apparatus, according to the invention, located between a toe-closer and a line-closer.

In the examples of FIGS. 3 and 4 of the attached drawings, the machine (3) is a toe-closer and machine (2) is a line-closer, although it could as well be a machine with shapes for stretching stockings or other.

In the examples shown by the figures of the attached drawings, each roller (4) is associated to a corresponding electrical stepping motor (40) via a drive belt (41) operating a sprocket wheel (42) which engages a corresponding toothing (43) of the roller (4). In this case, the structure (1) is in two parts (A, B), each of which carries a corresponding motor (40) with roller (4) which are movable from and to a longitudinal plane of symmetry (S—S) to allow the tensioning of each article (5) in the process of formation to be adjusted at will.

Provision is suitably made that the carriage (6) with hooks (60) be mounted on a structure allowing the lowering and respectively the lifting thereof for operation at different levels, in addition to the horizontal movement thereof between the machine (3) and the structure (1) with said positioning rollers (4).

To release the article (5) from the rollers (4), use can be made of a carriage (8) carrying hooks (80) developing parallel to each other and to the rollers (4) and spaced apart so as to allow the insertion thereof into the space between the rollers (4). Upon removal of the articles (5) from the rollers (4), the carriage (8) moves the hooks (80) which in turn urge the individual articles (5) along the rollers (4), as indicated by the arrows (H) in FIG. 1B, until they are fully withdrawn. Owing to the very elasticity of the fabric the articles (5) are made of, the latter adhere spontaneously to the surface of the hooks (80) which, suitably moved by the carriage (8), take the articles (5) up to the second machine (2), for example, up to the shapes (20) of a line-closer.

According to the invention, an operating method is implemented for the positioning of the textile tubular articles (5) through the rotation of each article (5) about its longitudinal axis until a longitudinal mark of the fabric is disposed in correspondence of the read axis of one or more detectors, wherein the said rotation is operated by drawing the fabric from the inside of the article. Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. Apparatus for positioning textile tubular articles according to a predetermined reference, characterized in that it comprises a structure with, for each article to be formed, two pairs of cylindrical parallel and superimposed rollers rotatable about respective longitudinal axes, and on which the article in the process of formation is able to be fitted: at least one of said pairs of rollers being associated to one or more detectors intended to detect a longitudinal reference of the article and to determine, upon said detection, the temporary compression-operated adhesion of the corresponding fabric portion of the article to the surface of a fixed body located between the vertically superimposed rollers of each pair by means of corresponding buffer pistons associated therewith.

2. Apparatus according to claim 1, characterized in that it is associable to means for automatically fitting the articles on the rollers, with at least a carriage with hooks developed parallel to each other and to rollers and spaced apart of such an extent as to position said hooks outside the rollers in order to fit the respective articles thereon, with the rollers arranged inside the article, by virtue of a translation operated in a direction parallel to the axis of development of the rollers, from a location in which the articles move towards the same rollers.

3. Apparatus according to claim 1, characterized in that it is associable to means for the automatic removal of articles being positioned, with at least a carriage with hooks developed parallel to each other and to the rollers and spaced apart so as to arrange said hooks inside the rollers in order to withdraw therefrom the respective articles by virtue of a translation operated in a direction parallel to the axis of development of the rollers from the rear to the front side of the rollers.

4. Apparatus according to claim 1, characterized in that each roller is associated to a corresponding electrical stepping motor via a drive belt operating a sprocket wheel which engages a corresponding toothing of the roller.

5. Apparatus according to claim 1, characterized in that the distance between the rollers is adjustable.

6. An apparatus for positioning a tubular textile article, the apparatus comprising:

a pair of rollers rotatable about respective longitudinal axes, said rollers being arranged substantially in parallel and spaced to fit inside the article;

a fixed body arranged between said pair of rollers;

a detector associated with said pair of rollers and detecting a longitudinal reference of the article on said pair of rollers;

a buffer piston associated with said fixed body and to establish compression-operated adhesion of the article to said fixed body upon detection of the longitudinal reference of the article.

* * * * *